US010593503B1

(12) United States Patent
Bier et al.

(10) Patent No.: US 10,593,503 B1
(45) Date of Patent: Mar. 17, 2020

(54) NETWORK PROTECTOR FUSE

(71) Applicants: Bruce Bier, Washington, DC (US); Christopher Juillet, Basking Ridge, NJ (US); Mantas Jarasunas, Helmetta, NJ (US); Jeffrey Madden, Montvale, NJ (US)

(72) Inventors: Bruce Bier, Washington, DC (US); Christopher Juillet, Basking Ridge, NJ (US); Mantas Jarasunas, Helmetta, NJ (US); Jeffrey Madden, Montvale, NJ (US)

(73) Assignee: Richards Manufacturing Company, LP, Irvington, NJ (US)

( * ) Notice: Subject to any disclaimer, the term of this patent is extended or adjusted under 35 U.S.C. 154(b) by 0 days.

(21) Appl. No.: 16/159,663

(22) Filed: Oct. 14, 2018

(51) Int. Cl.

| | |
|---|---|
| ***H01H 85/20*** | (2006.01) |
| ***H01H 85/175*** | (2006.01) |
| ***H01H 85/30*** | (2006.01) |
| *H01H 85/06* | (2006.01) |
| *H01H 85/17* | (2006.01) |

(52) U.S. Cl.
CPC .... *H01H 85/2045* (2013.01); *H01H 85/1755* (2013.01); *H01H 85/30* (2013.01); *H01H 85/06* (2013.01); *H01H 85/17* (2013.01)

(58) Field of Classification Search
CPC .. H01H 85/17; H01H 85/175; H01H 85/1755; H01H 85/2045; H01H 85/06; H01H 85/11; H01H 85/30
See application file for complete search history.

(56) References Cited

U.S. PATENT DOCUMENTS

| | | | | |
|---|---|---|---|---|
| 1,861,267 | A * | 5/1932 | Frank | H01H 85/20 337/188 |
| 4,723,117 | A * | 2/1988 | Griffiths | H01H 85/24 337/158 |
| 6,030,257 | A * | 2/2000 | Furuya | H01H 85/2045 439/620.26 |
| 9,892,880 | B2 * | 2/2018 | Schmidt | H01H 69/02 |
| 2004/0196135 | A1 * | 10/2004 | Clair | H01H 85/0417 337/198 |
| 2007/0075822 | A1 * | 4/2007 | Pachla | H01H 85/0086 337/297 |
| 2012/0223801 | A1 * | 9/2012 | Moon | H01H 69/02 337/265 |
| 2016/0268092 | A1 * | 9/2016 | Pflueger | H01H 85/042 |

* cited by examiner

*Primary Examiner* — Jacob R Crum
(74) *Attorney, Agent, or Firm* — Bakos & Kritzer

(57) ABSTRACT

A network protector fuse is disclosed. A fuse is coupled to a fuse cover of the network protector fuse utilizing fasteners. Further, at least one captive fastener is inserted into the fuse cover and configured to couple the network protector fuse to a network protector. The at least one captive fastener is restricted from dislodging from the fuse cover.

20 Claims, 5 Drawing Sheets

NETWORK PROTECTOR FUSE

TECHNICAL FIELD

The apparatus and methods disclosed herein relate to a network protector fuse comprising a captive fastener.

BACKGROUND

Secondary electrical distribution systems comprise of various interconnected low voltage grids which are supplied by two or more high voltage power sources. As a result, the loss of one high voltage power source due to an equipment and/or cable failure will not result in the interruption of service to customers. However, one issue commonly known as a backfeed condition can cause current to flow from the low voltage grid to the high voltage source. The backfeed condition is undesirable and can cause equipment failure. Currently, large switches known as network protectors are utilized to prevent the backfeed condition. The network protector is typically installed on the low voltage side of a transformer. A control portion of a network protector comprises sensors to detect a backfeed condition. When a backfeed condition is detected the network protector opens, thereby disconnecting the network protector from the transformer and eliminating the backfeed. Network protectors comprise fuses configured to protect the secondary electrical distribution systems in the event of an equipment failure. Typically, the fuse connects the load side of the network protector to the secondary electrical distribution system. The network protector can be energized (live-no load) or de-energized when fuses are installed.

Typically, the process of installing fuses inside a network protector enclosure utilizes threading loose components. The fuse is placed unsecured on a threaded stud (fuse stud) extending from a copper block of the network protector. Thereafter, the installer secures the fuse with swivel nuts comprising a nut and locking washers. Utility standards dictate that the installer use insulation gloves as part of their personal protection equipment (PPE). Due to the need for electrical insulation, the gloves are typically thick and cumbersome, thereby making it difficult for the installer to hold small components, including the loose fuse studs and fuse nuts utilized to secure fuses to the network protector. As a result, the loose fuse and fuse nuts can be dropped while removing or installing a fuse. Further, dropping components can damage the operating mechanism of the network protector, thereby significantly increasing the downtime of a secondary electrical system coupled to the network protector. Worse, the installer can risk personal injury to themselves by attempting to retrieve the dropped component while the network protector is energized. In addition, molten copper particles can be directed outwards in a violent manner when the fuse blows, thereby coating other components with copper particles that can result in electrical failures.

SUMMARY

The principles disclosed herein provide for a network protector fuse configured to minimize components being dropped during the installation and removal process of fuses to a network protector. The principles disclosed herein further provide for a simpler process for removal of a fuse or remnants of a fuse after it has operated. Further, the principles disclosed herein provide for a partial fuse cover configured to redirect potential arcs across a blown fuse. In addition, the principles disclosed herein provide for a fuse cover with a method of visually indicating that a fuse is blown.

BRIEF DESCRIPTION OF THE DRAWINGS

The detailed description makes reference to the accompanying figures wherein.

The figures are only intended to facilitate the description of the principles disclosed herein. The figures do not illustrate every aspect of the principles disclosed herein and do not limit the scope of the principles disclosed herein. Other objects, features, and characteristics will become more apparent upon consideration of the following detailed description.

DETAILED DESCRIPTION

A detailed illustration is disclosed herein. However, techniques, methods, processes, systems and operating structures in accordance with the principles disclosed herein may be embodied in a wide variety of forms and modes, some of which may be quite different from those disclosed herein. Consequently, the specific structural and functional details disclosed herein are merely representative.

Figure 1:
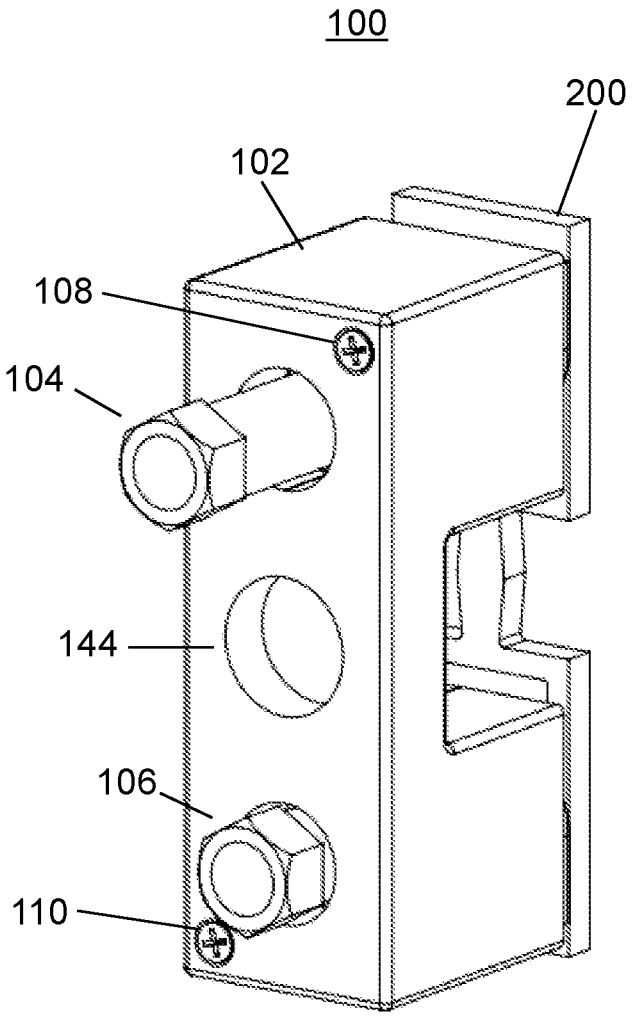
FIG. 1 illustrates a perspective view of a network protector fuse in accordance with the principles disclosed herein.
Figure 2:
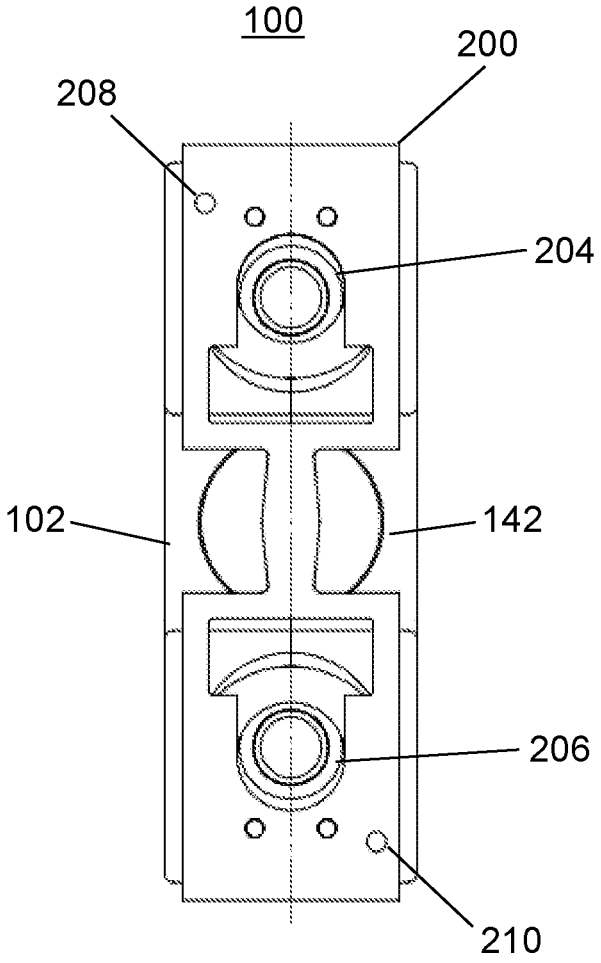
FIG. 2 illustrates a front view of a network protector fuse in accordance with the principles disclosed herein.
Figure 3:
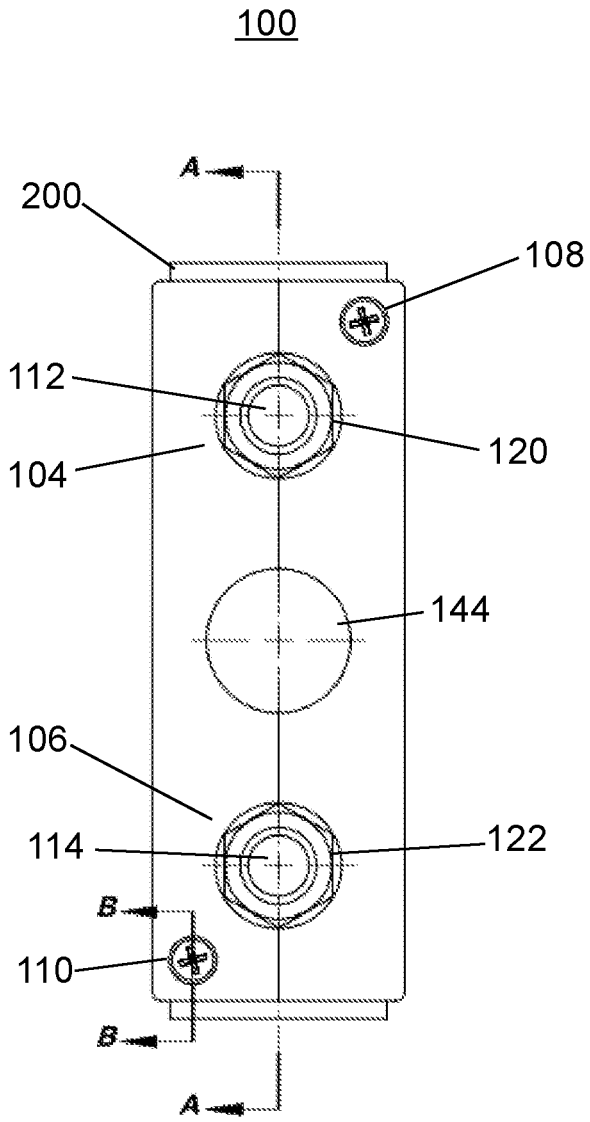
FIG. 3 illustrates a back view of a network protector fuse in accordance with the principles disclosed herein.

Referring initially to FIGS. 1-3, shown is a network protector fuse in accordance with the principles disclosed herein. As shown in FIG. 1, network protector fuse 100 comprises fuse cover 102 and fuse 200. Fuse cover 102 comprises an insulating body comprising a high temperature rated molded material. For example, the fuse cover can be configured to operate above 250 degrees Fahrenheit. An exemplary molded material includes, but is not limited to, a compound comprising cement and an inorganic filler material such as calcium carbonate. Further, fuse cover 102 is illustrated as having a generally C-shape. The C-shape is designed to provide a partial fuse cover configured to shield potential arcs that can exist across fuse 200 during fusing operation. Further, the C-shape is designed to reduce fragments of fuse 200 that are blown from damaging components installed near network protector fuse 100. Further, the C-shape provides for a location to grip and remove network protector fuse 100. It would be apparent to one of ordinary skill in the art that fuse cover 102 can be of other shapes without departing from the principles disclosed herein. Fuse 200 is coupled to fuse cover 102 utilizing fastener 108 and fastener 110. As shown in FIG. 1, captive fastener 104 remains coupled to fuse cover 102 although it has not been fully inserted into fuse cover 102. Captive fastener 106 is shown fully inserted into fuse cover 102. Further, fuse cover 102 comprises visual indicator 144. As described in detail below with reference to FIG. 4, visual indicator 144 is configured to allow the inspection of fuse 200 from back side 142.

Turning next to FIG. 2, fuse 200 comprises fuse body 202 and is shown as a Y fuse. Further, fuse 200 is composed of copper. It would be apparent to one of ordinary skill in the art that the use of other types of fuses including, but not limited to, a Z fuse can be utilized without departing from the principles disclosed herein. Further, it would be apparent to one of ordinary skill in the art that the fuse can include tin or silver plating depending on the application without departing from the principles disclosed herein. Also, the fuse can be composed of copper and silver or copper and tin-lead solder without departing from the principles disclosed herein. Fuse 200 also comprises captive fastener opening 204 and captive fastener opening 206. Further, fuse 200 comprises fastener opening 208 and fastener opening 210 which are configured to couple to fastener 108 and fastener 110 (shown in FIG. 1), respectively. While fastener opening 208 and fastener opening 210 are shown positioned on opposite corners of fuse 200, it would be apparent to one of ordinary skill in the art to change the location of the openings to secure the fuse without departing from the principles disclosed herein.

As shown in FIG. 3, captive fastener 104 and captive fastener 106 comprise hollow inner tube 112 and hollow inner tube 114, respectively. As described in detail below with reference to FIG. 4, the hollow inner tube comprises a threaded portion configured to couple to a stud of existing network protectors. Further, captive fastener 106 and captive fastener 104 comprise captive fastener head 120 and captive fastener head 122, respectively. As shown in FIG. 3, the width of fuse cover 102 is configured to slightly cover the width of fuse 200, thereby minimizing the width of fuse cover 102. The length of fuse cover 102 is configured to be slightly less than the length of fuse 200. As a result, network protector fuse 100 can be utilized in existing network protectors without additional modifications.

Figure 4:
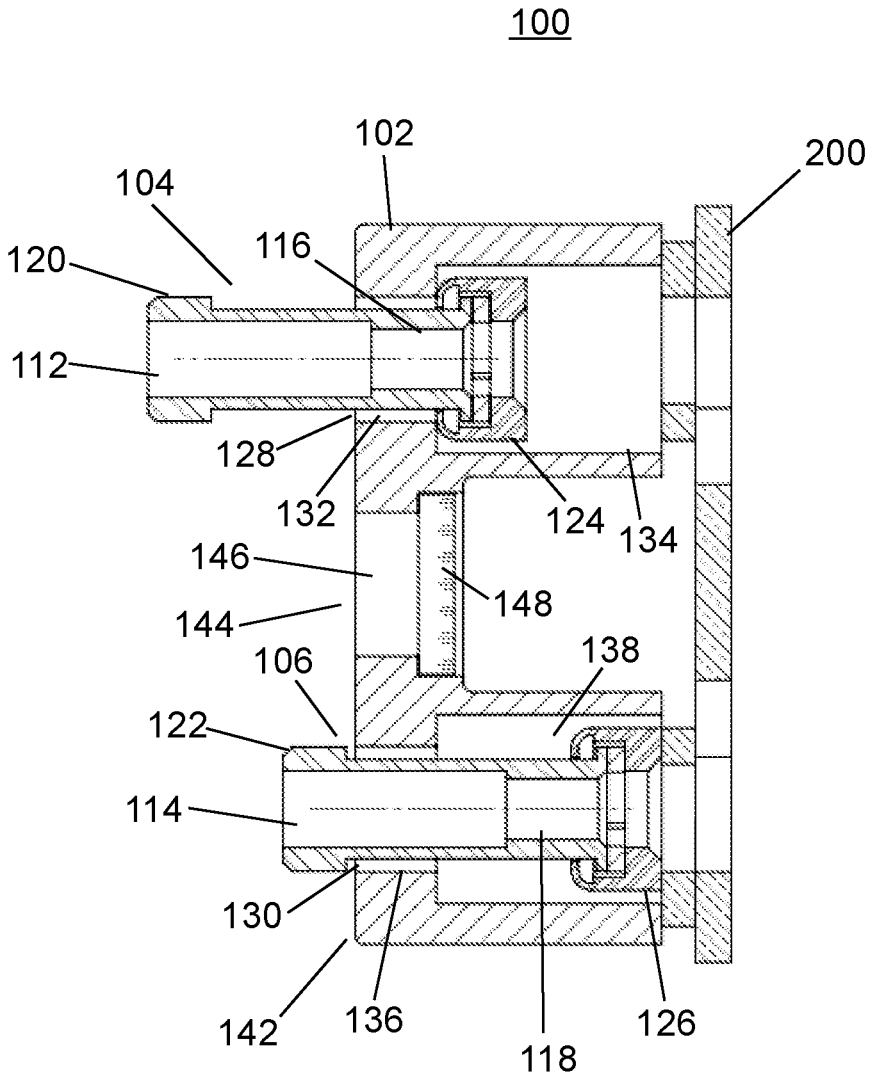
FIG. 4 illustrates a cross-sectional side view of section A-A shown in FIG. 3 in accordance with the principles disclosed herein.

Turning next to FIG. 4, shown is a cross-sectional side view of section A-A of FIG. 3. Captive fastener 104 comprises threaded portion 116 and captive fastener end 124. Similarly, captive fastener 106 comprises threaded portion 118 and captive fastener end 126. Thread portion 116 and threaded portion 118 are configured to couple to studs of existing network protectors. Fuse cover 102 comprises captive fastener channel 128 and captive fastener channel 130. As shown, captive fastener channel 128, is configured to prevent captive fastener 104 from dislodging from fuse cover 102. Captive fastener channel 128 comprises first portion 132 and second portion 134. First portion 132 and second portion 134 are cylindrically shaped and the radius of first portion 132 is configured to allow captive fastener 104 to move in and out of captive fastener channel 128. As shown in FIG. 4, the outer radius of captive fastener head 120 is greater than the radius of first portion 132, thereby restricting captive fastener 104 from dislodging from back side 142 of fuse cover 102. Further, the outer radius of captive fastener end 124 is greater than the radius of first portion 132, thereby restricting captive fastener 104 from dislodging from fuse cover 102 when captive fastener 104 is moved out of captive fastener channel 128.

As shown in FIG. 4, captive fastener 106 is inserted into captive fastener channel 130. The outer radius of captive fastener head 122 is greater than the radius of first portion 136 of captive fastener channel 130, thereby restricting captive fastener 106 from dislodging from back side 142 of fuse cover 102. Further the outer radius of captive fastener end 126 is greater than the radius of first portion 136, thereby restricting captive fastener 106 from dislodging from fuse cover 102 when captive fastener 106 is moved out of captive fastener channel 130. It would be apparent to one of ordinary skill in the art to utilize various other methods to prevent the captive fasteners from dislodging from the fuse cover without departing from the principles disclosed herein. As shown in FIG. 4, visual indicator 144 comprising sight window 148. Sight window 148 is positioned within aperture 146 of fuse cover 102. Further, sight window 148 is composed of a transparent high temperature rated molded material configured to allow the inspection of fuse 200 from back side 142.

Figure 5:
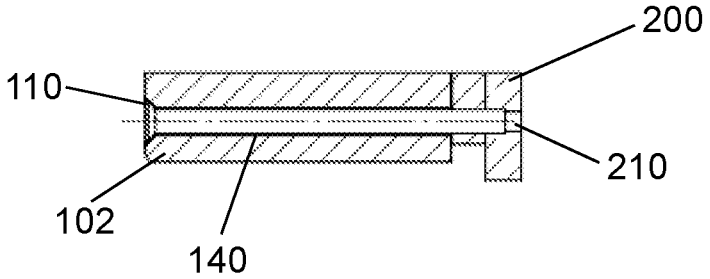
FIG. 5 illustrates a cross-sectional side view of section B-B in accordance with the principles disclosed herein.

FIG. 5 depicts a cross-sectional side view of section B-B shown in FIG. 3. As shown, fuse cover 102 comprises fastener channel 140. Fastener 110 is inserted into fastener channel 140 and threadably inserted into fastener opening 210 of fuse 200, thereby securing fuse 200 to fuse cover 102. Similarly, fastener 108 (shown in FIG. 3) is inserted into a fuse stud channel and threadably inserted into a fastener opening of fuse 200. To reduce the risk of dropping loose components during the installation process of network protector fuse 100 into a network protector, fastener 108 and fastener 110 can be inserted and/or removed from fuse 200 away from a network protector. Further, to reduce the risk of dropping loose components during the removal process of a blown fuse coupled to a network protector, fastener 108 and fastener 110 can be removed from a blown fuse 200 after removing network protector fuse 100 from a network protector.

The detailed description is not intended to be limiting or represent an exhaustive enumeration of the principles disclosed herein. It will be apparent to those of skill in the art that numerous changes may be made in such details without departing from the spirit of the principles disclosed herein.

What is claimed is:

1. A network protector fuse assembly comprising:

a fuse cover;

a fuse;

at least one captive fastener comprising a captive fastener head outside of the fuse cover, the at least one captive fastener further comprising a threaded portion;

at least one removable fastener;

wherein the fuse is coupled to the fuse cover utilizing the at least one removable fastener; and wherein the at least one captive fastener comprises an end opposite the captive fastener head and configured to restrict the at least one captive fastener from dislodging from the fuse cover.

2. The network protector fuse assembly of claim 1, wherein the fuse cover is C-shaped; and wherein the fuse cover does not enclose both sides of the fuse.

3. The network protector fuse assembly of claim 2, further comprising:

at least one captive fastener channel, comprising a first portion and a second portion; and at least one fastener channel for the removable fastener.

4. The network protector fuse assembly of claim 1, wherein the fuse comprises:

at least one captive fastener opening; and at least one fastener opening for the removable fastener.

5. The network protector fuse assembly of claim 1, wherein the fuse is a copper link fuse.

6. The network protector fuse assembly of claim 1, wherein the fuse cover is composed of a high temperature rated molding compound.

7. A network protector fuse assembly comprising:

a fuse cover;

a fuse;

a first captive fastener;

a second captive fastener;

a first removable fastener;

a second removable fastener;

wherein the fuse is coupled to the fuse cover utilizing the first removable fastener and the second removable fastener;

wherein the first captive fastener is inserted into a first captive fastener channel and restricted from dislodging from the first captive fastener channel; and wherein the second captive fastener is inserted into a second captive fastener channel and restricted from dislodging from the second captive fastener channel.

8. The network protector fuse assembly of claim 7, wherein the fuse cover is C-shaped.

9. The network protector fuse assembly of claim 7, wherein the fuse comprises:

at least one captive fastener opening; and at least one fastener opening.

10. The network protector fuse assembly of claim 7, wherein the fuse is a copper link fuse.

11. The network protector fuse assembly of claim 7, wherein the fuse cover is composed of a high temperature rated molding compound.

12. The network protector fuse assembly of claim 7, wherein the fuse is composed of tin plated copper.

13. The network protector fuse assembly of claim 7, wherein the first captive fastener channel comprises:

a first portion and a second portion;

wherein a radius of the second portion is greater than a radius of the first portion; and wherein a radius of a head of the first captive fastener is greater than the radius of the first portion and a radius of an end of the first captive fastener is greater than the radius of the first portion.

14. A network protector fuse assembly comprising:

a fuse cover, comprising at least one captive fastener channel and at least one fastener channel;

a fuse, comprising at least one captive fastener opening and at least one fastener opening;

at least one captive fastener comprising a captive fastener head outside of the fuse cover, the at least one captive fastener further comprising a threaded portion;

at least one removable fastener;

wherein the at least one removable fastener is inserted into the at least one fastener channel and coupled to the at least one fastener opening; and wherein the at least one captive fastener is inserted into the at least one captive fastener channel and restricted from dislodging from the at least one captive fastener channel.

15. The network protector fuse assembly of claim 14, wherein the fuse cover is C-shaped and comprises a visual indicator.

16. The network protector fuse assembly of claim 14, wherein the fuse is a copper link fuse.

17. The network protector fuse assembly of claim 14, wherein the fuse cover is composed of a high temperature rated molding compound.

18. The network protector fuse assembly of claim 14, wherein the at least one captive fastener channel comprises:

a first portion and a second portion;

wherein a radius of the second portion is greater than a radius of the first portion; and wherein a radius of the captive fastener head is greater than the radius of the first portion; and wherein the captive fastener comprises a captive fastener end with a radius greater than the radius of the first portion.

19. The network protector fuse assembly of claim 14, wherein the fuse is composed of copper and silver.

20. The network protector fuse assembly of claim 14, wherein the fuse is composed of copper and tin-lead solder.

* * * * *